United States Patent [19]

Kurihara et al.

[11] Patent Number: 4,761,089

[45] **Date of Patent: * Aug. 2, 1988**

[54] SYNTHETIC RESIN PEN NIB

[75] Inventors: Norigi Kurihara, Yachiyo; Ryutaro Sakuda, Tokyo, both of Japan

[73] Assignee: Aubex Corporation, Tokyo, Japan

[ * ] Notice: The portion of the term of this patent subsequent to Jul. 1, 2003 has been disclaimed.

[21] Appl. No.: 939,468

[22] Filed: Nov. 25, 1986

Related U.S. Application Data

[63] Continuation of Ser. No. 624,005, Jun. 25, 1984, abandoned.

[30] Foreign Application Priority Data

Jun. 27, 1983 [JP] Japan ..... 58-114371

[51] Int. Cl.[4] ..... B43K 1/12

[52] U.S. Cl. ..... 401/198; 401/199

[58] Field of Search ..... 401/196, 198, 199, 265, 401/292

[56] References Cited

U.S. PATENT DOCUMENTS

| | | | |
|---|---|---|---|
| 3,400,998 | 9/1968 | Daugherty et al. | 401/198 |
| 3,467,564 | 9/1969 | Daugherty et al. | 401/199 X |
| 3,538,208 | 11/1970 | Ohtsuka . | |
| 3,623,941 | 11/1971 | Goodenow | 401/196 |
| 3,627,868 | 12/1971 | Funahashi . | |
| 3,778,495 | 10/1974 | Woolley . | |
| 3,840,632 | 10/1974 | Maxion et al. . | |
| 3,933,965 | 1/1976 | Gallone et al. | 401/199 X |
| 3,946,094 | 3/1976 | Kanetsuna et al. . | |
| 3,963,678 | 6/1976 | Conrad et al. . | |
| 4,002,709 | 7/1977 | Mozer . | |
| 4,098,864 | 7/1978 | Morris et al. . | |
| 4,233,022 | 11/1980 | Brady et al. . | |
| 4,362,683 | 12/1982 | Otsuka et al. . | |
| 4,597,932 | 7/1986 | Kurihara et al. | 264/145 |

FOREIGN PATENT DOCUMENTS

| | | |
|---|---|---|
| 2214543 | 10/1972 | Fed. Rep. of Germany . |
| 2169160 | 9/1973 | France . |

*Primary Examiner*—Steven A. Bratlie

*Attorney, Agent, or Firm*—Renner, Otto, Boiselle & Sklar

[57] ABSTRACT

Thermoplastic synthetic resin pen nib is disclosed, which may suitably be employed in writing instruments for fine lettering or for drawing fine lines. The pen nib is formed of thermoplastic crystalline synthetic resin, e.g. polyethylene terephthalate resin, whose molecules are in a specific mixed cystallization structure obtained by controlling the crystallization. This structure consists essentially of molecularly oriented crystals, non-oriented fine crystals dispersed and grown between the oriented crystals, and remaining amorphous regions, and provides the pen nib with highly improved physical and chemical properties.

4 Claims, 2 Drawing Sheets

SYNTHETIC RESIN PEN NIB

This is a continuation of co-pending application Ser. No. 624,005, filed on June 25, 1984, now abandoned.

BACKGROUND OF THE INVENTION

1. Field of the Invention

The present invention relates to a pen nib comprising a rod-like core made of a thermoplastic synthetic resin and having axially continuous ink-conducting capillary channels of suitable cross-sectional shape, which may suitably be employed in writing instruments for fine lettering or for drawing fine lines.

2. Description of the Prior Art

Up to the present, the large majority of writing instruments for fine lettering or tracing fine lines, which are generally available on marketplace, have employed polyacetal resin pen nibs of relatively small diameter.

However, due to the practical limitations arising from insufficient flexural strenght of conventional polyacetal resin pen nibs, the length of exposure of the writing tip from the pen nib holder in these writing instruments has been restricted. When the polyacetol resin pen nib has an outer diameter of 0.8 mm, for example, these instruments are normally provided with a writing tip exposure length of from 1.0 to 1.5 mm in order to avoid breakdown or snap of the pen nibs when applied with the writing pressure, at the sacrifice of flexible and/or resilient writing feel which is an important requirement to be fulfilled. Thus, there has been demand for the development of synthetic resin pen nibs with an excellent flexural strength, that do not break or snap even at larger exposure lengths.

The above-described type of polyacetal pen nib develops from about 0.015 to 0.250 mm of tip wear per 100 meters of writing on commercially available high-grade paper or high-grade photocopier paper under a writing pressure of about 100 g. As a result, under the above-mentioned restricted writing tip exposure length and depending on the type of paper used, the writing tip may excessively wear down to have a writing life of only about 500 meters. This has prompted calls for the development of a synthetic resin pen nib with good wear resistance.

In addition, considerable variation may arise in the writing life of the writing instrument, depending on whether the principle solvent in the ink composition used is water, an organic solvent, or a mixture of the two. A synthetic resin pen nib that combines good chemical resistance and resistance to organic solvents with the physical properties already noted above has thus been awaited.

SUMMARY OF THE INVENTION

Accordingly, it is an object of the present invention to provide a greatly improved synthetic resin pen nib for writing instruments which mitigates the above-mentioned drawbacks of conventional pen nibs.

Another object of the present invention is to provide a novel synthetic resin pen nib having an improved writing performance, an excellent writing quality and a considerably prolonged writing life.

Still another object of the present invention is to provide a synthetic resin pen nib with an excellent flexural strength, improved wear resistance, and satisfactory chemical resistance and resistance to organic solvents.

In order to achieve these and other objects, according to the present invention, there is provided a pen nib for a writing instrument comprising a rod-like core made of a thermoplastic crystalline synthetic resin and having axially continuous ink-conducting capillary channels of suitable cross-sectional shape, wherein the synthetic resin molecules are in a mixed crystallization state forming a structure essentially consisting of molecularly oriented crystals, non-oriented fine crystals dispersed and grown between said oriented crystals, and remaining amorphous regions.

The present invention will be more fully described hereinafter, firstly with respect to the general aspect of the invention, and then by referring to some preferred embodiments and exemplary manufacturing methods of pen nibs according to the invention and shown in the following drawings.

DETAILED EXPLANATION OF THE INVENTION

Figure 1:
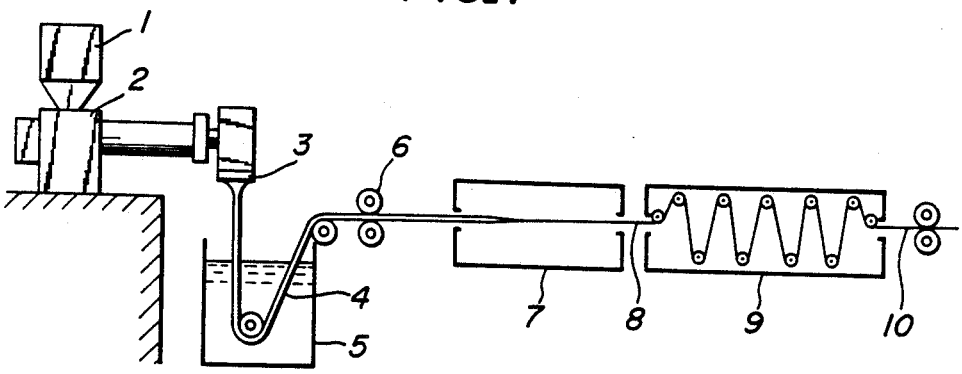
FIG. 1 is a schematic view showing one example of the manufacturing process which can be used to produce the synthetic resin pen nib according to the present invention.

The present invention has been accomplished after comprehensive researches and experimental studies to develop a highly improved synthetic resin pen nib with excellent physical and chemical properties as mentioned above, in the course of which the inventors arrived at a novel concept of the pen nib material, and in particular, of the crystallization state of the molecules when thermoplastic crystalline synthetic resin is used. The present invention is based on the recognition that pen nibs made of a thermoplastic crystalline synthetic resin in a specific mixed crystal state obtained by controlling the crystallization are very highly effective.

The present invention thus essentially concerns the improvement in a pen nib for a writing instrument whereby molecules of thermoplastic crystalline synthetic resin are in a mixed crystallization state forming a structure essentially consisting of molecularly oriented crystals, non-oriented fine crystals dispersed and grown between said oriented crystals, and remaining amorphous regions.

The present invention will now be described in greater detail, beginning with the explanation with respect to the significance of formation of the specific mixed crystal structure according to the invention.

With the oriented crystallization of the synthetic resin molecules, the synthetic resin pen nibs constituted as described above acquire an outstanding resistance to wear of the writing tip by friction with the paper surface during writing.

Furthermore, non-oriented fine crystals dispressed and grown between these oriented crystals result in a higher degree of crystallization and the formation of a mixed crystal structure with an even finer crystallization state. This prevents relaxation of the oriented crystals, resulting in a pen nib with outstanding rigidity and flexural strength. The non-oriented fine crystals between the oriented crystals serve to protect against the tendency, with oriented crystallization, towards axial crack formation in the pen nib when external stresses act upon the writing tip. Generally stated, such a tendency would very likely be unavoidable in case of a mixed crystal structure wherein synthetic resin molecules are once grown into spherulites and then subjected to axial stretching by applying a large tensile stress in an attempt to induce an oriented crystallization. Moreover, according to the invention, the existence of numerous non-oriented crystals grown as fine crystals within the remaining amorphous regions has the effect of compensating for the general tendency of uncontrolled elastic or plastic deformation of the amorphous material when subjected to external stresses. As a result, the writing tip of the pen nib comes into contact with the paper surface at the synthetic resin molecular surface in a mixed crystal state that comprises oriented crystals, non-oriented fine crystals, and remaining amorphous regions.

The mixed crystal structure according to the invention thus provides excellent strength and durability against external stresses such as compression, bending, and friction to which the writing tip is subjected during writing, making it possible to realize a pen nib with a long writing life and a good writing quality.

As concerns the selection of materials and manufacturing method, conventional synthetic resin pen nibs do not have a mixed crystal structure such as the above-described one of the invention. Even when thermoplastic crystalline synthetic resin material is used in conventional nibs, rather than being oriented, the crystals are non-oriented and in a crystallization state in which they are combined with amorphous material. Furthermore, even when the crystals are in some type of oriented state, this is only of the extent that results from stretching of the synthetic resin material in the molten state, and is not an oriented crystallization state in which the molecular chain in fully extended.

Some preferred embodiments of the present invention will be described below together with practical examples of the manufacturing method.

EXAMPLE 1

As shown in FIG. 1, polyethylene terephthalate resin fed from a hopper 1 into an extruder 2 was extruded, in its molten state, from an extrusion die 3 having a suitable orifice shape and mounted onto the cylinder head of the extruder, and was shaped into a molten bar with longitudinal pores formed therein for the intended provision of inkconducting capillary channels. Subsequently, in order to place this bar in as amorphous a state as possible, the bar was immersed in a cooling water tank 5 where it was rapidly cooled and hardened to form a transparent continuous rod 4 of desired cross-sectional shape with an outer diameter of 1.6 mm. The degree of crystallization of the synthetic resin in this rod, as measured by the so-called "density method" (ASTM[D792]; 23° C. ), was found to be about 0.07, confirming that most of the molecules were in an amorphous state.

This rod 4 of desired cross-sectional shape was then passed to a heating oven 7 by means of adjusting rollers 6, where tensile stress was applied while heating at about 130° C. to stretch the rod continuously to about four times its original length, forming a monofilamentous core 8 measuring 0.8 mm in outer diameter and having the ink-conducting capillary channels. The crystallinity of the synthetic resin in this core, when measured as above by the density method, was found to have increased to about 0.17, confirming that stretching-induced oriented crystallization took place to form molecularly oriented crystals.

Following this, the core 8 was passed through a heating oven 9 having a non-oxidizing atmosphere formed by nitrogen gas, where it was heat-treated at about 200° C. for 30 minutes while preventing the axial shrinkage. This accelerated crystallization of the non-oriented amorphous regions within the synthetic resin, giving a transparent rod-like core 10, which was then cut to the desired lengths and shaped into an appropriate pen nib configuration. The crystallinity of the synthetic resin in the heat-treated rod-like core 10 was measured as before by the density method, whereupon it was found that crystallization had progressed even further, reaching a value of about 0.53. This confirmed that the amorphous regions dispersed by the process of oriented crystallization described above did not enlarge into spherulites, but rather, have grown between the oriented crystals and remaining amorphous material, formed the desired molecularly mixed crystal structure.

Figure 2A:
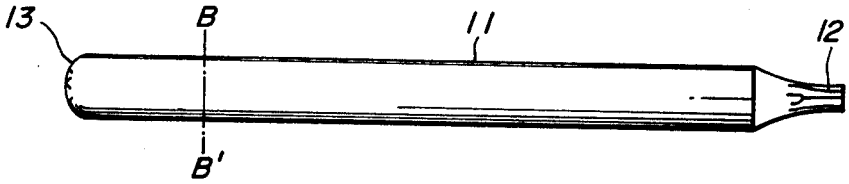
FIG. 2A shows the side view of the pen nib according to one embodiment of the present invention.
Figure 2B:
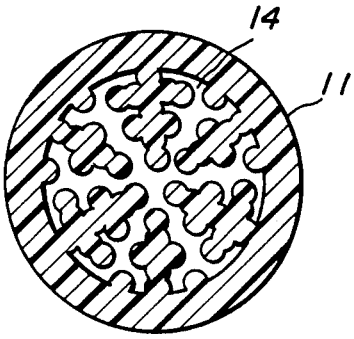
FIG. 2B is a cross-sectional view taken along the line B–B' in FIG. 2A.
Figure 3:
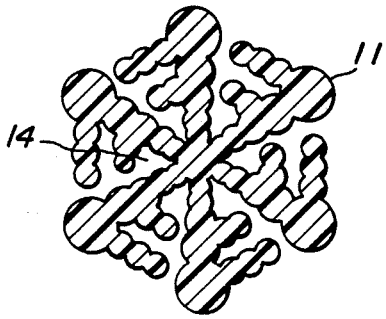
FIG. 3 is a cross-sectional view of another embodiment of the pen nib.

FIGS. 2A and 2B represent the shape of the pen nib thus obtained, in which the pen nib 11 is shown as being provided with an ink absorption end 12 and a writing tip end 13 and, in the cross-section, has ink-conducting capillary channels 14. FIG. 3 shows the cross-section of another example of the pen nib. It is of course that the present invention is not limited to pen nibs having specific cross-sectional shapes or configurations of ink-conducting capillary channels shown in FIG. 2B and FIG. 3; rather, it can be applied to various types of pen nib cross-section some of which, for example, are disclosed in U.S. Pat. No. 3,932,044 and U.S. Pat. No. Re. 30,659 both assigned to the assignee of the present invention.

The following experiments have been conducted to investigate the effects of stretching in the present invention.

The transparent rod 4 of desired cross-sectional shape and in an amorphous state obtained by rapid cooling and solidification in the above Example 1 was stretched at a temperature of 130° C. and a stretch ratio ranging from 1 to 4.5. The stretched rods were then heat-treated, promoting crystallization to a crystallinity of about 0.53. Wear and flexural strength tests were carried out with respect to the pen nibs formed from the heat-treated rods, whose test results are presented in FIG. 4. The wear test results are given as the amount of wear at the writing tip when the sample is used to write 100 meters on high-quality Japanese-made photocopier paper in a standard pen nib wear test. The flexural strength is given as the resilience (load) when a given amount of deflection is imparted to a pen nib placed across support points.

Figure 4:
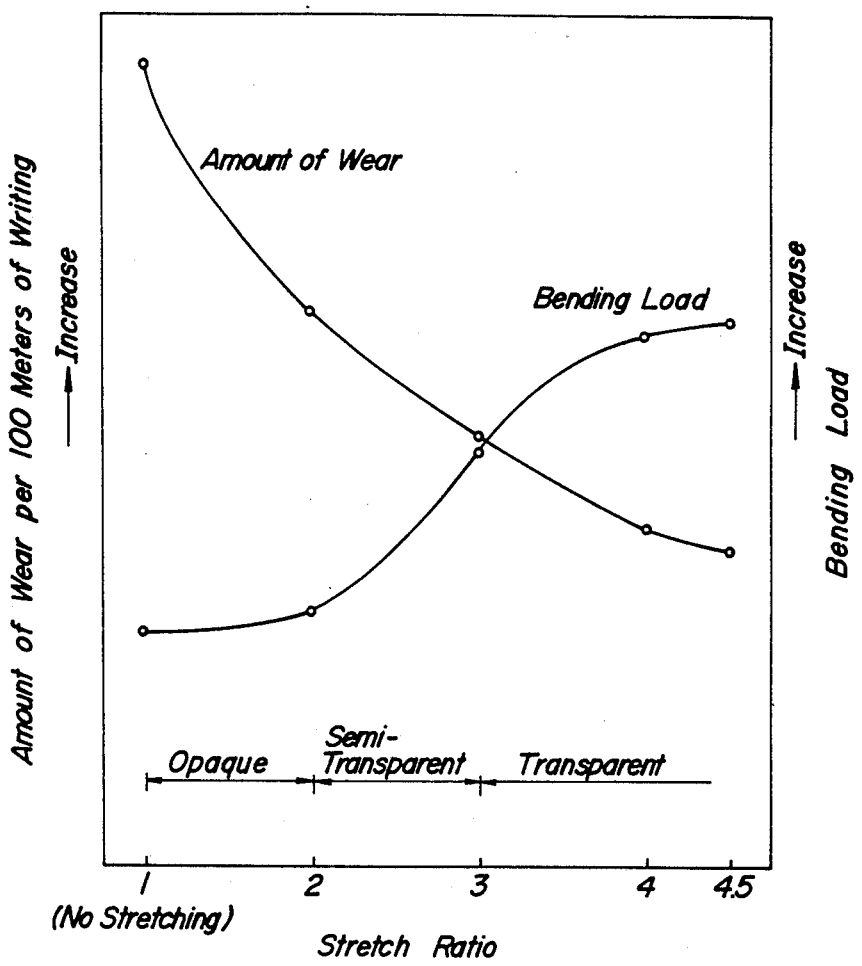
FIG. 4 is a diagram showing the relationship between the stretch ratio during the stretching operation, versus the wear resistance and flexural strength of the pen nib according to the invention.

As is apparent from FIG. 4, when heat-treated in a non-stretched state, large spherulites are formed resulting in devitrification and whitening. Here, even though an excellent rigidity is attained as the maximum ultimate crystallinity is approached, the product is brittle and has inferior wear-resistance and poor elasticity. The whitening effect is due to the scattering of light by the enlarged spherulites.

However, when the stretch ratio is at least 2, there is only a slight decrease in transparency; devitrification is clearly suppressed, in addition to which a considerable reduction can be seen in the amount of wear, and the flexural strength (deflection strength) is improved. Further increase in the stretch ratio gives pen nibs with almost perfect transparency, superior rigidity and elasticity, and excellent wear resistance.

Tests were conducted to compare the physical properties of the polyethylene terephthalate resin (PET) pen nib according to the above-mentioned embodiment with those of conventional polyacetal copolymer resin (POM-C) pen nibs. The test results are shown in Tables 1 to 3.

Table 1 gives the results of tests conducted to determine the wear resistance of the pen nibs in terms of the amount of wear (mm) of the respective writing tips. The tests were carried out using a standard writing test machine with respect to pen nibs each having an outer diameter of 0.8 mm, and made to write over a length of 100 meters at an angle of 70°, a load of 100 grams, and a writing speed of 9 m/min. To clarify the variations in wear properties arising with paper type, four types of paper were used: high-grade Japanese-made paper A, high-grade Japanese-made photocopier paper D, European writing test paper B, and U.S. writing test paper C.

TABLE 1

| Amount of pen nib wear (mm) on various types of writing paper per 100 meters of writing | | | | |
|---|---|---|---|---|
| | POM-C pen nib | | | |
| Writing paper | PET pen nib | (1) | (2) | (3) | Wear ratio* |
| A | 0.0075 | 0.015 | 0.015 | 0.018 | 1/2.1 |
| B | 0.012 | 0.028 | 0.031 | 0.030 | 1/2.5 |
| C | 0.040 | 0.163 | 0.180 | 0.190 | 1/4.4 |
| D | 0.076 | 0.240 | 0.249 | 0.247 | 1/3.2 |

*Numerator is amount of wear of PET pen nib (=1).

As is clear from Table 1, the synthetic resin pen nib of the present embodiment has an excellent wear resistance, the level of wear being less than one-half that of conventional pen nibs for all the types of paper used in the test.

Table 2 gives the results of tests conducted to determine the flexural strength, which is an important property when very slender rod-like cores are employed as pen nibs. The testing method was essentially the same as that conventionally used to determine the strength of pencil leads. The length of the writing tip projecting from the nib holder was varied and the load resistance (kg) determined at the flex yield point (angle, 60°).

TABLE 2

| Exposed length of tip (mm) | Flexural strength [kg] PET pen nib | POM-C pen nib (1) | (2) | (3) | Strength ratio* |
|---|---|---|---|---|---|
| 1.1 | 1.31 | 0.78 | 0.86 | 0.86 | 1.57/1 |
| 1.5 | 1.12 | 0.62 | 0.69 | 0.70 | 1.67/1 |
| 1.8 | 0.91 | 0.58 | 0.61 | 0.64 | 1.49/1 |
| 2.0 | 0.83 | 0.55 | 0.59 | 0.54 | 1.48/1 |

*Denominator is flexural strength of POM-C pen nib (=1).

As is evident from Table 2, the strength of the synthetic resin pen nib of the present embodiment at an ordinarily used writing tip exposure length of from 1.0 to 1.5 mm is about 1.6 times greater than that of conventional pen nibs. This strength is very advantageous when the diameter of the pen nib used in a writing instrument is made smaller than that of the embodiment. Another advantage is that the length of the writing tip extending out from the holder can be made relatively long. Thus, it can be understood that the pen nib of the present embodiment has, together with the above-mentioned wear resistance, a considerably extended writing lifetime, and an excellent writing quality afforded by suitable rigidity and elasticity.

Table 3 shows the results of tests conducted to determine the chemical and solvent resistances to various types of ink components. Pen nibs having an outer diameter of 0.8 mm and a length of 25 mm were immersed at 50° C. for three days in various ink components. Dimensional changes [%] in the outer diameter and length, and the flexural strength [g] are determined.

TABLE 3

| Chemical and solvent resistances | | | | | | | | |
|---|---|---|---|---|---|---|---|---|
| | PET pen nib | | | | POM-C pen nib | | | |
| Ink components | Change in diameter (%) | Change in length (%) | Flexural strength (g) | Change in strength (%) | Change in diameter (%) | Change in length (%) | Flexural strength (g) | Change in strength (%) |
| Distilled water | 0 | 0 | 123 | +3 | 0 | +0.4 | 54 | −22 |
| HCl 1 N | 0 | 0 | 127 | +2 | −5.7 | +1.2 | 20 | −71 |
| HCl 0.1 N | 0 | 0 | 126 | +3 | 0 | +0.8 | 58 | −13 |
| NaOH 1 N | 0 | 0 | 124 | 0 | 0 | +0.8 | 56 | −16 |
| NaOH 0.1 N | 0 | 0 | 125 | +2 | 0 | +0.8 | 56 | −16 |
| Ethanol | +0.6 | 0 | 124 | +2 | −0.1 | +3.2 | 44 | −35 |
| Ethylene glycol | 0 | 0 | 128 | +3 | 0 | +1.2 | 54 | −19 |
| MEK | +1.9 | +0.8 | 66 | −47 | 0 | +2.2 | 20 | −70 |
| Ethyl acetate | +1.3 | +0.4 | 90 | −28 | −0.6 | +3.0 | 32 | −53 |
| Methyl Cellosolve | 0 | 0 | 113 | −9 | 0 | +2.4 | 36 | −46 |
| Toluene | 0 | 0 | 124 | 0 | 0 | +1.4 | 38 | −43 |

Note: Flexural strength is measured as the reaction force when pressed down 0.6 mm at the center of a pitch o 15 mm.

As is clear from Table 3, the polyacetal resin used up to the present in almost all pen nibs employed in writing instruments for fine lettering or drawing fine lines, swells and undergoes a decrease in strength when immersed in organic solvents of relatively low molecular weight, commonly used as ink components, such as alcohols, glycols, and Cellosolves. However, virtually no decrease occurs in the strength of the polyethylene terephthalate resin in the present embodiment. In fact, the present embodiment is even superior when immersed in esters and ketones, which tend to produce the largest drops in strength. The pen nib of the present embodiment also has a better durability with respect to such components as HCl detected in some ink. It is thus quite clear that the pen nib of the present embodiment has superior chemical and solvent resistances to all ink components.

EXAMPLE 2

Another monofilamentous core 8 has been formed in the manner described above with reference to Example 1. This core was passed through the heating oven 9 with nitrogen gas atmosphere, where it was heat-treated at about 230° C. for one hour while preventing the axial shrinkage. The rod-like core 10 obtained in this way exhibited the crystallinity of about 0.62 as measured by the density method, which is substantially the same as the maximum ultimate crystallinity of spherulites of the synthetic resin used. The rod-like core was then cut to desired lengths and shaped into the pen nib configuration. The pen nib thus manufactured was then compared with that of Example 1 above, by which no essential differences could be recognized with respect to wear resistance, flexural strength, chemical resistance and resistance to organic solvents, except for further improved smooth writing feel.

The pen nibs of Examples 1 and 2 were compared with pen nibs consisting of conventional material and having essentially the same cross-sectional shape, by using a writing test machine under very severe conditions. As the result, for some limited range of writing conditions, ink discharge property of the pen nibs of the present invention exhibited the tendency of undergoing a slight deterioration which, however, will not be detrimental to practical use.

In the present invention, a thermoplastic crystalline synthetic resin is used as the synthetic resin pen nib raw material. Moreover, of such resins, it is desirable to use crystalline synthetic resin materials from which amorphous rods can readily be formed and whose crystalliztion rate is relatively low, that have not hitherto been regarded at all as suitable raw materials. Crystalline synthetic resins with a rapid crystallization rate or for which the formation into amorphous rods is difficult, are not very approriate both from the standpoint of manufacturing and product function, because crystals are first grown into spherulites and then stretched by the large tensile stresses to which the material is subjected during oriented crystallization.

Moreover, improvements in the physical properties can be achieved as the crystallinity of the rod-like core following the acceleration of crystallization by the above-mentioned heat treatment approaches the maximum ultimate crystallinity of the crystalline synthetic resin material used. In the case of the polyethylene terephthalate resin of the above-mentioned embodiment having a maximum ultimate crystallinity of about 0.6, the crystallinity in the mixed crystal state preferably is made at least 0.45, or made substantially the same as the maximum ultimate crystallinity achieved by the spherulite structure of the synthetic resin. The crystallinity should be increased preferably in a non-oxidizing atmosphere, in order to avoid undesirable thermal deterioration of the mixed crystal structure in an oxidizing atmosphere.

The present invention is not limited to the pen nibs consisting of polyethylene terephtalate resin; for example, pen nibs having the mixed crystal structure according to the invention can readily be manufactured from polyether etherketone resin also, whose maximum ultimate crystallinity amounts to approximately 0.48 and which belongs to thermoplastic crystalline synthetic resin with relatively low crystallization rate, like the above-mentioned polyethylene terephtalate resin. Furthermore, polyethylene 2, 6 naphthalate resin and polybutylene terephthalate resin are also considered appropriate since, for such resin materials, formation into amorphous rods can be effected without any difficulties.

The diameter of the pen nib in practice is preferably no greater than 2 mm; when reduced to 1.5 mm or less, the nib demonstrates even more distinctive results. If a monofilamentous core with such a small diameter is enclosed in a thermoplastic synthetic resin sheath, it can be used as a nib with a diameter of 2 mm or greater.

Thus, as has been amply explained above, the present invention enables provision of a synthetic resin pen nib for use in writing instruments, with superior physical and chemical properties required for such a pen nib. In this way, it fully responds to the demands on the marketplace for a superior pen nib.

What is claimed is:

1. A pen nib for a writing instrument, consisting essentially of a rod-like core formed initially by extruding a molten thermoplastic crystalline synthetic resin into a continuous rod and rapidly cooling said rod to place it in as amorphous a state as possible, said rod-like core having axially continuous ink-conducting capillary channels of suitable cross-sectional shape wherein molecules of said synthetic resin have a mixed crystal structure which consists essentailly of molecularly-oriented crystals, non-oriented fine crystals dispersed and grown between said oriented crystals, and remaining amorphous regions, said mixed crystal structure being formed by subjecting said rod subsequent to such rapid cooling step to heat and stretching said rod while at the same time reducing the rod diameter to achieve oriented crystallization of said synthetic resin molecules and then heat treating such rods so as to cause the growth of said non-oriented fine crystals and accelerate crystallization of said amorphous regions, said amorphous regions being included in said mixed crystal structure of the synthetic resin molecules to such an extent as to form a semi-transparent or a transparent material.

2. A synthetic resin pen nib as claimed in claim 1, wherein said synthetic resin molecules have a crystallinity which is substantially the same as the maximum ultimate crystallinity of the crystalline synthetic resin.

3. A synthetic resin pen nib as claimed in claim 1 wherein the crystalline synthetic resin is polyethylene terephthalate resin.

4. A synthetic resin pen nib as claimed in claim 3, wherein the state of crystallization of the synthetic resin molecules, expressed in terms of the crystallinity as measured by the density method [ASTM(D792); 23° C.], is at least 0.45.

* * * * *

UNITED STATES PATENT AND TRADEMARK OFFICE

CERTIFICATE OF CORRECTION

PATENT NO. : 4,761,089

DATED : August 2, 1988

INVENTOR(S) : Norigi Kurihara and Ryutaro Sakuda

It is certified that error appears in the above-identified patent and that said Letters Patent is hereby corrected as shown below:

Title page, field [21], the Application No. "939,468" should read --936,468--; and Claim 1, line 9, "essentailly" should read --essentially--.

Signed and Sealed this

Thirtieth Day of May, 1989

*Attest:*

*Attesting Officer*

DONALD J. QUIGG

*Commissioner of Patents and Trademarks*